US006877532B2

(12) United States Patent
Olson et al.

(10) Patent No.: US 6,877,532 B2
(45) Date of Patent: Apr. 12, 2005

(54) PURGING SYSTEM FOR A LIQUID DISPENSING NOZZLE

(75) Inventors: David C. Olson, Minneapolis, MN (US); Edward L. Schwarz, Minneapolis, MN (US)

(73) Assignee: Invision Investments, Inc., Minneapolis, MN (US)

( * ) Notice: Subject to any disclaimer, the term of this patent is extended or adjusted under 35 U.S.C. 154(b) by 0 days.

(21) Appl. No.: 10/448,587

(22) Filed: May 29, 2003

(65) Prior Publication Data

US 2004/0250875 A1 Dec. 16, 2004

(51) Int. Cl.[7] ..... B67C 3/02; B67D 1/08

(52) U.S. Cl. ..... 141/90; 141/85; 141/89; 141/91; 222/148

(58) Field of Search ..... 141/67, 69, 85, 141/89–91, 285, 290, 309; 222/148

(56) References Cited

U.S. PATENT DOCUMENTS

| | | | | | |
|---|---|---|---|---|---|
| 1,526,001 | A | * | 2/1925 | La Rue | 222/148 |
| 3,580,420 | A | * | 5/1971 | Kennedy et al. | 222/1 |
| 3,977,604 | A | | 8/1976 | Yokoyama et al. | 239/102 |
| 4,098,437 | A | | 7/1978 | Reinke | 222/529 |
| 4,141,393 | A | | 2/1979 | Mayer | 141/206 |
| 4,331,190 | A | | 5/1982 | Sutcliffe et al. | 141/392 |
| 4,709,735 | A | | 12/1987 | Chang | 141/209 |
| 4,984,612 | A | | 1/1991 | de la Haye | 141/198 |
| 5,377,729 | A | | 1/1995 | Reep | 141/392 |
| 5,482,094 | A | | 1/1996 | Mitchell | 141/209 |
| 5,603,364 | A | | 2/1997 | Kerssies | 141/392 |
| 6,209,569 | B1 | | 4/2001 | Sharp | 137/234.6 |
| 6,311,742 | B1 | | 11/2001 | Nusen et al. | 141/206 |
| 6,491,282 | B1 | | 12/2002 | Fink, Jr. | 251/319 |

* cited by examiner

*Primary Examiner*—Timothy L. Maust
(74) *Attorney, Agent, or Firm*—Nawrocki, Rooney & Sivertson, P.A.

(57) ABSTRACT

A liquid-dispensing nozzle has a system for blowing air for a period of time through the nozzle's spout after the liquid valve closes. The flow of air purges and expels most of the liquid adhering to the interior surface of the spout, preventing this residual liquid from contaminating either the ground on which it may fall when the spout is withdrawn from a filler pipe or the air through evaporation. The invention applies particularly well to dispensing of liquid fuels such as gasoline.

23 Claims, 2 Drawing Sheets

PURGING SYSTEM FOR A LIQUID DISPENSING NOZZLE

BACKGROUND OF THE INVENTION

Systems are found throughout the world for managing delivery of liquids from a storage tank to a contained space such as a tank or other container. Typically, a pump is provided to pressurize the liquid as it is being delivered, but gravity may also be used on occasion. For example, fuels such as gasoline or diesel fuel are delivered by a pump from a storage tank to vehicle fuel tanks. While the invention can be used for a variety of liquids, we feet at this time that it will be most useful for liquid fuel delivery.

Such delivery occurs most frequently at retail gas stations where end users (motorists) manage the delivery themselves. Liquid fuel delivery will be used as the example to explain the invention. Other types of liquids and systems may be able to take advantage of the invention as well.

Colloquially, the term "gas pump" is used to refer to the entire fuel delivery unit. To avoid confusion, hereafter we will use the term "pump system" to refer to the entire device that pumps, meters, and controls fuel flow to a vehicle or other fuel holding tank. The term "fuel pump" or "gas pump" refers to the actual pump that pulls and pressurizes liquid fuel contained in a larger storage tank.

In a pump system, the fuel pump provides pressurized fuel to a metering system that determines the amount of fuel that flows during a fuel delivery event. The pressurized fuel is supplied to a manually operated fuel nozzle through a hose. Fuel nozzles are used to safely manage this fuel delivery. The decades-old design still in use for fuel nozzles has an internal main fuel valve that is manually operated by a motorist with an external lever. Fuel flowing from the valve passes through a spout inserted into a filler pipe of the vehicle, and then into the tank to be filled. The motorist wishing to fill a fuel tank operates the lever to control and stop fuel delivery.

Fuel nozzles now usually include a detent to hold the lever in one of several positions providing various rates of flow. A sensor detects imminent overflow and releases the detent to prevent spillage. These sensor mechanisms work quite well in shutting off fuel flow before spillage occurs.

However, small amounts of fuel usually remain in the nozzle and particularly, the spout after the main valve closes. When the motorist removes the spout from the filler pipe, this fuel can drop to the ground or drip on the paint surrounding the filler pipe. This fuel escaping from the spout after the main valve closes is a safety hazard, causes both air and ground pollution, and can damage the paint around the filler pipe. Accordingly, this fuel escape is undesirable, and should be minimized.

A number of different systems have been developed over the years to reduce this fuel escape. U.S. Pat. Nos. 5,337,729 and 6,331,742 for example provide check valves at the end of the spout to retain fuel within the spout after the main valve has closed.

BRIEF DESCRIPTION OF THE INVENTION

We have developed a different type of system for preventing escape of liquids such as fuel when that liquid is transferred from a tank to another contained space such as a tank. Instead of attempting to retain the liquid remaining in the liquid nozzle downstream from the main valve, our system purges the nozzle and spout before the spout is removed from the filler pipe or opening. Most of the liquid remaining in the nozzle and spout (hereafter downstream chamber, or more briefly, chamber) is ejected or purged by a jet of compressed air or other noncombustible gas that is automatically blown into the downstream chamber each time the lever controlling liquid flow is released.

Such a liquid delivery system for controlling the flow of a pressurized liquid to a storage tank or other contained space and reducing the amount of escaping liquid when the delivery process is complete, includes a nozzle with a housing having internal ducting receiving the pressurized liquid from a source such as a hose. A liquid valve is operable between an open setting allowing flow of liquid through the ducting and a closed setting opposing liquid flow. Typically an actuator such as a lever to be operated manually controls the liquid valve setting.

A spout attached to the housing receives liquid from the liquid valve for delivering the liquid to the storage tank. The spout has an internal passage defined by an internal surface and an outlet from which liquid flows into the vehicle or other tank.

An air vent is located within the spout. An air valve controls flow of compressed air from a source typically external to the nozzle, to the air vent. The air valve opens responsive to an actuation force. A purge linkage between the liquid valve and the air valve provides actuation force to the air valve responsive to a change in the liquid valve from the open setting to the closed setting.

DESCRIPTION OF THE PREFERRED EMBODIMENT

Figure 1:
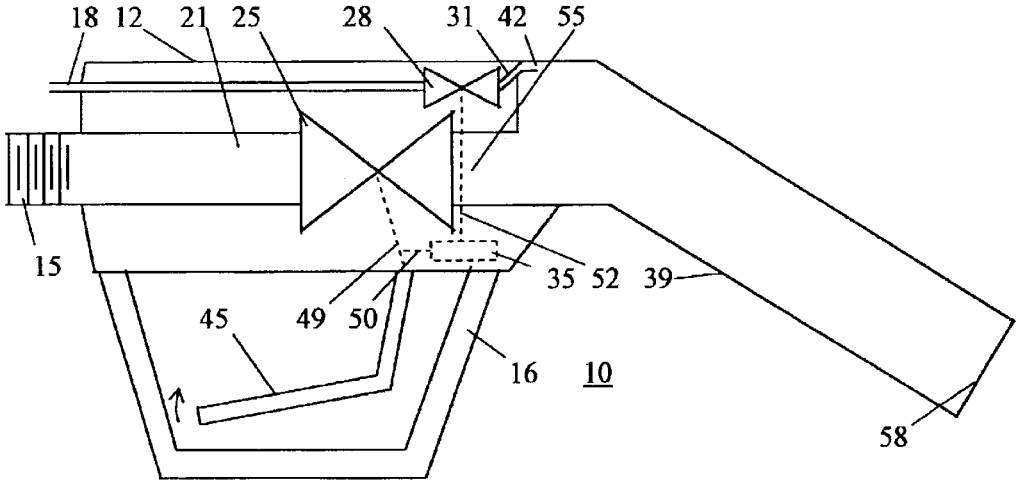
FIG. 1 shows an interior side view of a fuel nozzle incorporating the invention.

FIG. 1 shows an interior view of a simple fuel nozzle 10 that incorporates the invention and that may form part of a fuel delivery system. As mentioned, the design can apply to liquids other than fuel.

A housing 12 encloses the various elements in this embodiment, although other configurations are easily possible. A conventional design for a nozzle 10 has an internal inlet fuel duct 21 having an external threaded fitting 15 for attaching to a hose carrying pressurized fuel provided by a fuel pumping system. As will be discussed, future fuel delivery system designs may place many control components outside the nozzle housing 12.

A fuel valve 25 is shown in generic form. Fuel valve 25 can be operated between at least one open setting and a closed setting in which no fuel can flow through valve 25. Fuel valve 25 can have any suitable design that reliably controls fuel flow from inlet duct 21 to an outlet duct at 55. A spout 39 has an internal passage that receives fuel flowing from fuel valve 25 and through outlet duct 55. Fuel in spout 39 flows from a spout outlet 58 into the tank to be filled. Duct 55 and spout 39 will be referred to hereafter as the downstream chamber.

Valve 25 is operated by an actuator such as flow control lever 45, typically pivoted on a shaft (not shown) within housing 12. A guard 16 attached to the outside of housing 12 shields lever 45 from inadvertent actuation. Lever 45 is shown in the no-flow position for valve 25.

A link 49 is connected between lever 45 and fuel valve 25. When lever 45 is moved in the direction of the adjacent arrow, link 49 operates valve 25 into the open setting. A spring, not shown, constantly urges fuel valve 25 and lever toward the closed setting. Link 49 can take any convenient form that reliably and efficiently controls the fuel valve 25 setting.

The invention uses a rapid flow of air or other noncombustible gas through outlet duct 55 and spout 39 immediately after valve 25 is closed, to drive or purge fuel wetting the internal surfaces of duct 55 and spout 39 into the tank to be filled. (The term "air" is intended to include any noncombustible gas.) To accomplish this, an air (noncombustible gas) duct 18 supplies compressed air or other non-combustible gas to an air (non-combustible gas) valve 28. The compressed gas source may be an external compressor connected by a hose to the end of duct 18, or can be internal to housing 12. Air valve 28 controls flow of compressed air to an outlet pipe 31 that supplies the compressed air to an air vent 42 within the downstream chamber and adjacent to the upstream end thereof. Air vent 42 is oriented to direct air flow toward the spout outlet 58.

The volume and velocity of air supplied must be adequate to purge the internal surfaces of the downstream chamber of the fuel film remaining after the liquid fuel has drained from the space. More will be said below about these considerations.

Vent 42 is aimed to direct a jet of air toward the internal surfaces of outlet duct 55 and spout 39. In the simple example of FIG. 1, only a single, relatively small round vent 42 is shown, but the shape, size, and placement of the air vent or vents 42 can have any number of forms.

A symbolically shown purge controller 35 operates air valve 28 through a linkage 52. When linkage 52 is shifted to a first position by controller 35, air valve 28 opens and compressed air flows to duct 31 and vent 42. When controller 35 shifts linkage 52 to a second position, air valve 28 closes.

A link element 50 senses the position of lever 45 to communicate the setting of fuel valve 25 to purge controller 35. Purge controller 35 acts to open air valve 28 during a time interval upon sensing each closing of fuel valve 25. Purge controller 35 can use other means to sense closings of fuel valve 25 as well, such as directly monitoring fuel flow stoppage.

Purge controller 35 will typically comprise a tinier mechanism that operates to hold air valve 28 open for a preselected time interval. The timer mechanism can have a number of different structures and may be electronic or mechanical. Purge controller 35 is activated each time valve 25 is closed by releasing lever 45, to provide for a period of time, a flow of air through duct 31 and vent 42.

Figure 2A:
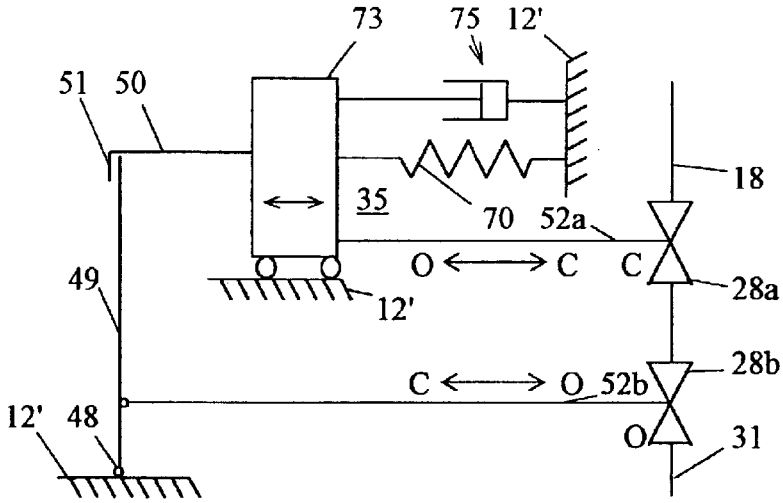
FIGS. 2*a*–2*c* show one design for a purge controller.
Figure 2B:
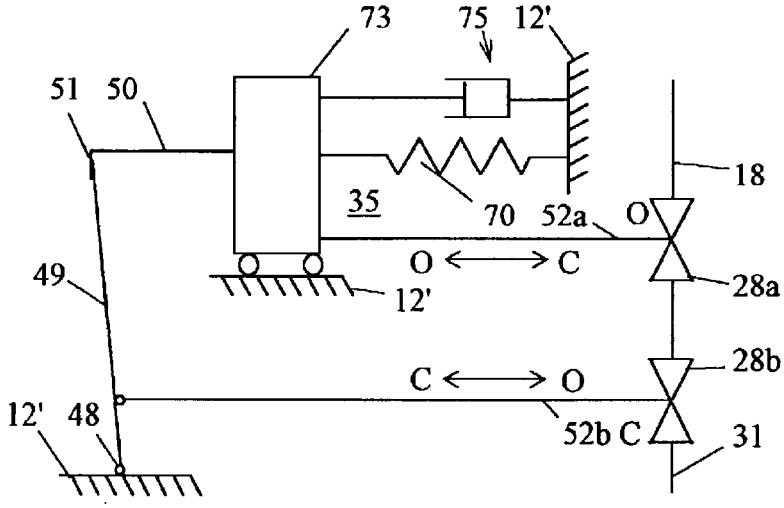
Figure 2C:
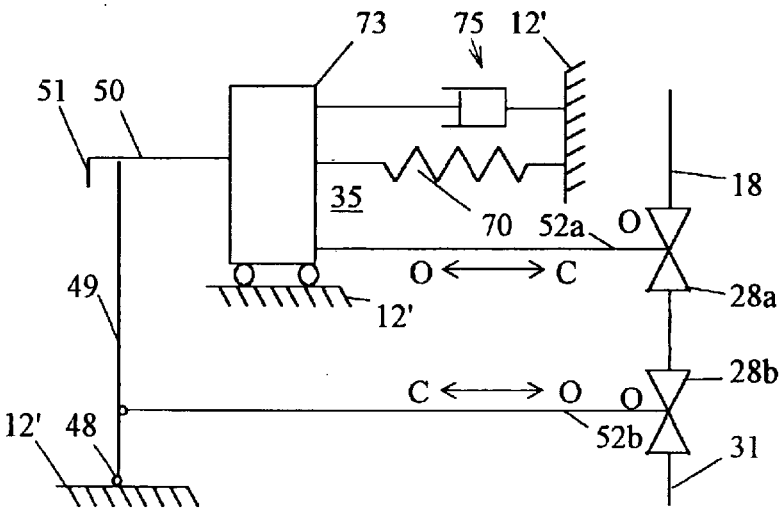

FIGS. 2*a*, 2*b*, and 2*c* are related schematics showing different operating phases of a functional mechanical version of a timer device usable as purge controller 35. This design includes a pair of air valves 28*a* and 28*b* connected in series to control flow of air from duct 18 to duct 31 and that together with the duct connecting them form valve 28 of FIG. 1. Most certainly, the purging process can be controlled electronically where electrical power is available to nozzle 10. And perhaps, better mechanical purge controllers can be devised as well.

FIG. 2*a* shows controller 35 and valves 28*a* and 28*b* in a rest state where valve 25 is closed and the purging operation complete for the last time valve 25 was open. FIG. 2*b* shows controller 35 and valves 28*a* and 28*b* in a flow state where valve 25 is open. FIG. 2*c* shows controller 35 and valves 28*a* and 28*b* in a purge state existing immediately after valve 25 has closed. All of these elements comprising purge controller 35 are mounted within and attached to various parts of the housing generally designated as 12'.

In this simple design, valve 28*a* has a control element 52*a* that opens valve 28*a* when shifted to the left as symbolized by the "O" on the left-pointing arrowhead. Valve 28*a* closes when the control element 52*a* is shifted to the right, as shown by the right-pointing arrow labeled "C".

Valve 28*b* has a control element 52*b* that closes valve 28*b* when shifted to the left as symbolized by the "C" on the left-pointing arrowhead. Valve 28*b* opens when the control element 52*b* is shifted to the right, as shown by the right-pointing arrow labeled "O".

The purge time is controlled by an extension spring 70 and a dashpot 75 connected in parallel between a portion 12' of housing 12 and a guide or carrier 73. Spring 70 and dashpot 75 form a timer element similar in function to the well-known screen door closers, although smaller in size and designed for handling much smaller forces.

Dashpot 75 has a piston or plunger that translates within a cylinder. Air flows slowly from the cylinder when the piston is pushed rightward creating substantial mechanical resistance to rightward movement. The piston provides little or no resistance to movement in the leftward direction. A check valve of some sort (not shown) provides this force difference.

Spring 70 is pretensioned to constantly provide force urging carrier 73 rightward. Spring 70 may be of the type providing linearly increasing force in response to extension as carrier 73 shifts to the left.

Carrier 73 translates along a straight line path as shown by the adjacent double ended arrow. The small circles beneath carrier 73 simply suggest rolling of carrier 73 on a flat surface. More often, carrier 73 will comprise a shaft sliding in a track or guideway. We chose the symbology shown for easier understanding. Carrier 73 is pulled to the left by linkage element 50 against the force of spring 70. Thus, carrier 73 and linkage element 50 cooperate with dashpot 75 and spring 70 to control the position of valve control elements 52*a* and 52*b*.

The position of carrier 73 is controlled to all intents and purposes by force applied by link 49 to linkage element 50, and by force from dashpot 75 and spring 70 only. That is, any effects of valves 28*a* and 28*b* on the position of carrier 73 can be ignored.

In FIGS. 1 and 2*a*, link 49 holds valve 25 shut. In this state, valve 28*a* is closed and valve 28*b* is open, as indicated by the "C" and "0" near them. Air cannot flow from duct 18 to duct 31.

Linkage element 50 is actuated leftward when link 49 rotates to the position opening fuel valve 25 as shown in FIG. 2*b*. Link 49 rotates on a pivot 48 shown symbolically as a small circle. Link 49 engages a tab or catch 51 to move linkage element 51 and carrier 73 to the left when link 49 is operated to the open position as shown in FIG. 2*b*. In transitioning to this position, carrier 73 simultaneously opens air valve 28*a* and closes air valve 28*b*. Air still cannot flow from duct 18 to duct 31.

When fuel flow stops, link 49 rotates clockwise from the position in FIG. 2*b* to the position shown in FIG. 2*c*, opening valve 28*b*, as indicated by the adjacent "O". Valve 28*a* is also open and remains open for an interval whose length depends on the resistive force provided by dashpot 75 and the force from spring 70. During this interval, compressed air flows from duct 18 to duct 31 and vent 42, purging the downstream chamber of residual fuel. When the piston in dashpot 75 returns to the position in FIG. 2*a* and valve 28*a* closes, the purge phase has ended.

The length one should chose for this time interval depends on a number of factors. At this point we have identified the following factors as important in determining the time interval to choose:

1) finish on the internal surface of the downstream chamber;
2) type of material forming the internal surfaces of the downstream chamber;
3) volume and shape of the downstream chamber;
4) velocity and volume of air flowing from vent 42;
5) shape, number, and position of vent 42; and
6) type of fuel or other liquid.

Items 1, 2, and 6 affect the amount of fuel clinging to the internal surfaces of the downstream chamber. Items 3, 4, and 5 affect the efficiency of the purge operation. Of course, the interval length must be short enough so that the motorist will not have withdrawn spout 39 from the filler pipe before the purge operation is complete, typically less than 2 sec. As a practical matter, this aspect involves human engineering.

We expect that the air flowing from vent 42 will diffuse throughout the downstream chamber with a substantial velocity component directed toward outlet 58. Fuel clinging to the internal surfaces of the downstream chamber will be flushed and purged by the moving air stream, and fall from outlet 58 and the air stream as the air velocity slows outside of the outlet 58.

The volume of air is controlled for the most part by the supply pressure, pressure drops within the air or gas flow passages, and the area of vent 42. These parameters should be adjusted to provide a total volume of atmospheric air or non-combustible gas preferably at least twice the total volume of the downstream chamber. Up to 4 times the total volume of the downstream chamber of compressed air or other gas should normally be adequate.

The finish and material of the interior surfaces in the downstream chamber affect the amount of fuel that adheres to these surfaces and ease with which it is removed by the airflow. Liquid fuels do not easily wet certain plastics. A smooth, shiny surface also is not as easily wet as a rough surface.

Figure 3:
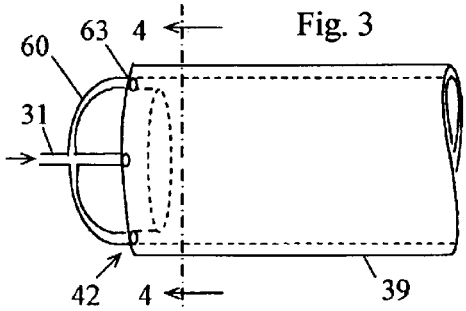
FIGS. 3 and 4 are side and end views of an upstream portion of the nozzle containing one form of an air vent for directing air through the fuel spout.
Figure 4:
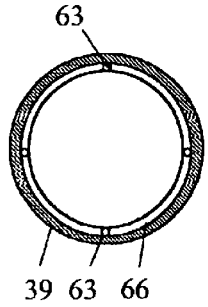

FIGS. 3 and 4 show one possible configuration for a compressed air vent 42. In the side view of FIG. 3, compressed air from valve 28 flows through ducts 60 to a number of individual vents 63 spaced around an annular air guide 66. The high speed air diffuses within guide 66 and purges the fuel adhering to the downstream surfaces out of outlet 58. One may also design a shroud or guide that creates an annular vent, with the diffusion of the air velocity occurring further upstream.

While the embodiment shown places the spout purging components in nozzle 10, one can envision other embodiments where the air valve 28 and purge controller 35 are in the system housing. Then the spout purging components in nozzle 10 may consist only of outlet pipe 31 and air vent 42.

In this configuration, an air hose runs along the fuel delivery hose directly to outlet pipe 31 from the air valve 28 within the system housing. The sensing of the position of lever 45 may be done indirectly by sensing fuel flow. When fuel flow ceases, then purge controller 35 senses this condition and opens air valve 28. Air then flows from a compressed air source to outlet pipe 31 and through vent 42.

Once one shifts the location of the air flow control elements outside of nozzle 10, then it is easy to use electrical devices to control airflow. In this case, purge controller 35 can be implemented electrically, using a microprocessor for example. Microprocessors can easily provide for precise timing of the purging airflow, triggering purging airflow when the fuel valve 28 closes and fuel flow ceases.

In another configuration nozzle 10 receives electrical power through the fuel delivery hose, in which case purge controller 35 may be located within housing 12, but comprise electrical components and operate electrically. Even an air pump could be integrated into the nozzle 10, possibly replacing air valve 28.

Such a design could effectively eliminate the need for a system housing, and might have a display integrated with nozzle 10. This display could show information in real time regarding the transaction. The nozzle 10 could also scan a credit card and provide information to a shared printer that provides a receipt for the transaction.

All of these variations as they apply to air purging of nozzles for delivery of liquids such as liquid fuel are intended to be included in the following claims.

We claim:

1. A liquid delivery system for controlling the flow of a pressurized liquid to a contained space, comprising:

a) a nozzle having a housing having internal ducting for receiving the liquid;
b) a liquid valve in the housing for controlling the flow of pressurized liquid through the ducting and operable between an open setting allowing flow of liquid from the ducting and a closed setting opposing liquid flow;
c) an actuator for controlling the liquid valve setting;
d) a spout attached to the housing and receiving liquid from the liquid valve for delivering the liquid to the contained space, said spout having an internal passage defined by an internal surface and an outlet from which liquid flows;
d) an air vent located within the spout;
e) an air valve for controlling flow of compressed air from a source to the air vent, said valve opening responsive to an actuation force; and
f) a purge linkage between the liquid valve and the air valve for providing actuation force to the air valve responsive to a change in the liquid valve from the open setting to the closed setting.

2. The liquid delivery system of claim 1, wherein the purge linkage includes a purge controller for holding the air valve open for a predetermined time interval responsive to the liquid valve changing from the open to the closed setting.

3. The liquid delivery system of claim 2, wherein the purge controller comprises a timer mechanism providing actuation force to the air valve.

4. The liquid delivery system of claim 3, wherein the timer mechanism includes a spring and a dashpot cooperating to provide a time interval during which the air valve is open.

5. The liquid delivery system of claim 1, wherein the air vent is oriented to direct air flow toward the spout outlet.

6. The liquid delivery system of claim 5, wherein the air vent forms an annular exit with the spout's internal surface.

7. The liquid delivery system of claim 6, wherein the air vent is located adjacent to the upstream end of the spout.

8. The liquid nozzle of claim 7, wherein the spout's internal surface comprises material that is substantially non-wetting to at least one liquid.

9. The liquid nozzle of claim 8, wherein the internal surface has a predetermined finish.

10. The liquid nozzle of claim 1, wherein the internal surface has a predetermined finish.

11. A liquid nozzle for controlling the flow of a pressurized liquid to a contained space, comprising:

a) a housing having internal ducting for receiving the liquid;

b) a spout attached to the housing and receiving at an upstream end thereon, liquid from the ducting for delivering the liquid to the contained space, said spout having an internal passage defined by an internal surface and an outlet from which liquid flows;

c) a liquid flow control element for connection to operate a liquid control valve;

d) an air vent located adjacent to the upstream end of the spout; and e) an air duct connected to the air vent, for receiving compressed air.

12. The liquid nozzle of claim 11, wherein the air vent is directed toward the spout outlet.

13. The liquid nozzle of claim 12, wherein the air vent forms an annular exit with the spout's internal surface.

14. The liquid nozzle of claim 13, wherein the spout's internal surface comprises material that is substantially non-wetting to at least one liquid fuel.

15. The liquid nozzle of claim 14, wherein the spout's internal surface has a predetermined finish.

16. The liquid nozzle of claim 11, wherein the spout's internal surface has a predetermined non-wetting finish.

17. The liquid delivery system of claim 11, wherein the air vent is located within and adjacent to the upstream end of the spout.

18. The liquid nozzle of claim 13, including a liquid control valve connected between the ducting and the spout and controlled by the flow control element, wherein the spout's internal surface comprises material that is substantially non-wetting to at least one liquid fuel.

19. The liquid nozzle of claim 11, including an air valve for controlling flow of compressed air to the air duct, and a linkage between the liquid flow control element and the air valve allowing the liquid flow control element to control the flow of compressed air through the air valve.

20. The liquid nozzle of claim 19, wherein the air valve and the linkage between the liquid flow control element and the air valve cooperate to open the air valve as the liquid flow control element closes the liquid control valve.

21. The liquid nozzle of claim 11, adapted to receive pressurized liquid from a flexible hose.

22. The liquid nozzle of claim 21 including: an air valve in series with the air duct to control flow of pressurized air through the air duct; and a linkage connecting the liquid flow control element with the air valve, allowing the liquid flow control element to operate the air valve.

23. The liquid nozzle of claim 22, including a liquid valve operated by the liquid flow control element, and wherein the linkage between the liquid flow control element and the air valve allows the liquid flow control element to initiate flow of compressed air through the air valve upon the liquid valve control element closing the liquid valve.

* * * * *